US005841041A

United States Patent [19]

Asano et al.

[11] Patent Number: 5,841,041

[45] Date of Patent: Nov. 24, 1998

[54] POROUS MOLD MATERIAL FOR CASTING AND A METHOD OF PRODUCING THE SAME

[75] Inventors: Norihiro Asano, Toyohashi; Tatsuhiko Kato, Shinshiro, both of Japan

[73] Assignee: Sintokogio, Ltd., Nagoya, Japan

[21] Appl. No.: 715,562

[22] Filed: Sep. 18, 1996

[30] Foreign Application Priority Data

Sep. 22, 1995 [JP] Japan ..... 7-269149

[51] Int. Cl.[6] ..... B22I 3/12; C22C 1/08; C22C 1/09

[52] U.S. Cl. ..... 75/229; 75/246; 419/2; 419/24; 419/26; 419/29; 419/53; 419/55

[58] Field of Search ..... 75/229, 246; 419/2, 419/24, 26, 29, 53, 55

[56] References Cited

U.S. PATENT DOCUMENTS 5,152,828 10/1992 Tatsuhiko ..... 75/229

FOREIGN PATENT DOCUMENTS 0 121 929 10/1984 European Pat. Off. .
0 139 972 5/1985 European Pat. Off. .
0 707 910 4/1996 European Pat. Off. .
4-72004 3/1992 Japan .
6-33112 2/1994 Japan .

OTHER PUBLICATIONS

"Mold Steel that Breathes," *Automotive Engineering,* vol. 103, No. 5, May 1, 1995, p. 18.

*Primary Examiner*—Ngoclan Mai
*Attorney, Agent, or Firm*—Fish & Neave; Jeffrey H. Ingerman; Brett G. Alten

[57] ABSTRACT

A porous mold material is provided that contains pores for ventilation in a metal casting, which pores range from 20 to 50 microns, and wherein the porosity value of the porous mold material ranges from 25 to 35% by volume. A method is further provided of producing a porous mold material that contains pores ranging from 20 to 50 microns for ventilation in casting, which method is characterized in that the mixing ratio of stainless steel particles to stainless steel short fibers is from 40 wt %:60 wt % to 65 wt %:35 wt %. The porous mold material of this invention does not have defects such as the inferior fluidity of a molten metal in the mold, or the shrinkage and blowholes in cast products.

3 Claims, 1 Drawing Sheet

POROUS MOLD MATERIAL FOR CASTING AND A METHOD OF PRODUCING THE SAME

BACKGROUND OF THE INVENTION

1. Field of the Invention

This invention relates to a porous mold material and a method of producing the same. This material is useful to provide a mold for use in metal castings. The material contains pores for ventilation throughout all of it.

2. Prior Art

Various casting methods, such as low-pressure die casting, counter gravity die casting, and die casting, have been proposed for producing cylinder heads or intake manifolds from a non-ferrous metal such as aluminum, by using a mold.

However, these casting methods, when a mold produced from a material such as SKD61 (alloyed tool steel stipulated in Japanese Industrial Standard G 4404) is used, have led to the inferior fluidity of a molten metal, and led to gas defects in cast products. The reason is that gaseous materials or air could not be discharged from the interior of a mold when it was filled with the molten metal. To avoid this, providing holes on the mold for ventilation or gas exhaust systems has been proposed. However, it has been impossible to provide holes for ventilation in all necessary parts of the mold, and large gas exhaust systems have been needed.

Japanese Patent Early-Publication No. 4-72004 discloses a method of producing a porous mold. In this method particles of SUS434 stainless steel are pressed to form a pressed body. This pressed body is sintered, nitrided, furnace cooled, and rapidly cooled to form the porous mold. This mold is useful especially for non-ferrous metal casting or die casting and so forth. Throughout this mold many fine cavities are uniformly distributed. Therefore, it is entirely unnecessary to provide holes for ventilation, and the mold has superiority in discharging gases and in its transfer characteristics.

However, the mold produced based on that publication still has insufficient workability and strength, even though they depend on a method to use the mold. Further, there has been a problem in that the mold lacks strength, hardness, and compression strength, and in that its life is short.

Japanese Patent Early-Publication No. 6-33112 discloses a method of producing a porous mold material. This method aims to provide excellent mechanical characteristics and a long life, while good ventilation characteristics and resistance to corrosion are kept.

This method comprises pressing a mixture of from 80% by weight of powder, mainly comprising particles of low-C and low N-Cr stainless steel, with from 20% by weight of stainless steel short fibers having a conversion diameter (of a circumscribed circle of the rectangular cross section of a fiber) of from 20 to 100 microns and a length of 0.4 to 3.0 mm, to form a pressed body, sintering said pressed body to form a sintered body, nitriding said sintered body by heating it under a nitrogen atmosphere to form a nitrided body, rapidly cooling said nitrided body at an average cooling rate of 5.5° C./min or more to a temperature of 250° C. or less, and reheating said cooled nitrided body at a temperature of between 500° to 650° C.

However, a mold material produced only on the basis of the above method is insufficient for a porous mold for casting.

SUMMARY OF THE INVENTION

This invention aims to resolve the above problems and to provide a porous mold material suitable for casting and a method of producing the same.

By one aspect of this invention a porous mold material for casting is provided. The porous mold material is formed from a mixture of powder mainly comprising particles of ferrite stainless steel with stainless steel short fibers, by pressing, sintering, applying a nitrogen injection treatment, and cooling and reheating said mixture. It is characterized in that said porous mold material contains pores which range from 20 to 50 microns, and in that the porosity value of said porous mold material ranges from 25 to 35% by volume.

By another aspect of this invention a method of producing a porous mold material for casting, which mold material contains pores ranging from 20 to 50 microns, and in which the porosity value of said material ranges from 25 to 35% by volume, is provided. It comprises pressing a mixture of powder, mainly comprising particles of ferrite stainless steel with stainless steel short fibers, to form a pressed body, sintering said pressed body to form a sintered body, applying a nitrogen injection treatment to said sintered body by heating it under a nitrogen atmosphere to form a nitrided body, rapidly cooling said nitrided body, and reheating said cooled nitrided body, characterized in that the mixing ratio of said stainless steel particles to said stainless steel short fibers is from 40 wt %:60 wt % to 65 wt %:35 wt %.

The porous mold material of this invention is characterized by the pore size and the porosity value. By changing the mixing ratio of the stainless steel particles to the stainless steel short fibers, the pore size and the porosity value can be selected.

By this invention, it is unnecessary to provide holes for ventilation and gas exhaust systems in the metal-casting process. Therefore, the adhesion of castings to a mold is improved. Further, no clogging of pores in the mold occurs. Therefore, there are many technical effects that reduce the insufficient fluidity of the molten metal in the cavity of the mold and that reduce the gas defects.

PREFERRED EMBODIMENTS OF THE INVENTION

Figure 1:
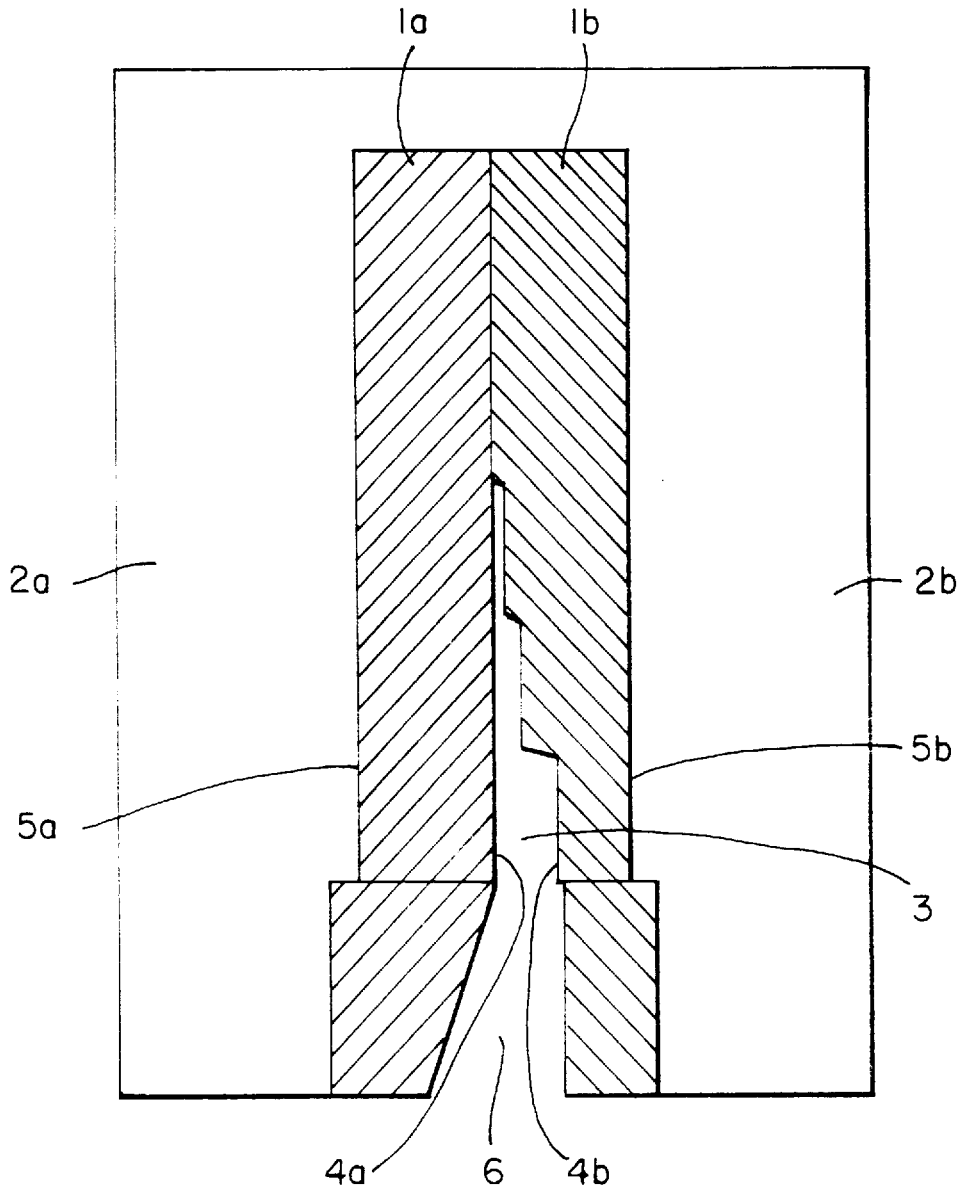
FIG. 1 is a sectional view of the mold used in the experiments of this invention.

A first embodiment of this invention will now be explained below.

A mixture (mixed by a V-blender KOTOBUKI Mix-well V1-30) of 50% by weight of stainless steel short fibers having a length of 2.0 to 3.5 mm prepared by pulverizing (by a rotary cutter mill of RCM 400) stainless steel long fibers (a conversion diameter of 60 to 80 microns) of SUS434 (C: 0.1%, Cr: 18%, Mo: 1%) and 50% by weight of stainless steel particles of SUS434 (C: 0.05%, Cr: 17%, Mo: 2%) having a size of mainly from 300 to 500 microns with 3% by weight of electrolytic copper particles (to enhance sintering and the binding power of the stainless steel particles) was pressed under a pressure of 3 tons/cm$^2$ by a cold isostatic pressing method (a CIP method) to form a pressed body. After the pressure of the pressed body was reduced in a vacuum furnace to $2\times10^{-4}$ Torr or less, the temperature of the pressed body was raised so that a temperature of 700° C. was kept for 2 hours to sufficiently deaerate vaporizable ingredients. Then, the temperature of the pressed body was raised so that a temperature of 1145° C. was kept for 4 hours while nitrogen under a pressure of from 5 to 15 Torr was introduced, thereby to produce a sintered body. Thereafter, furnace cooling was carried out up to 980° C. Next, a nitrogen gas was introduced into the furnace under a pressure of 950 Torr at a temperature of 980° C. to apply a nitrogen injection treatment to the sintered body, thereby causing the nitrogen content of the sintered body to be of from 1.0 to 1.5% by weight. Then, the nitrided body was rapidly cooled at an average cooling rate of 5.5° C./min or more up to 250° C. or less while a nitrogen gas under a pressure of 3,000 Torr was introduced. Further, the pressed body was reheated at a temperature of between 600° and 680° C., so that a porous mold material of a rectangular body (about 700×300×200 mm) was obtained.

Table 1 shows the characteristics of the porous mold material obtained by the above method.

TABLE 1

| Pore Size | Porosity Value | Microvickers Hardness (HMV) | Flexural Strength |
|---|---|---|---|
| 30 microns | 28% | 350 | 52.3 kgf/mm$^2$ |

The pore size in the porous mold was measured by using an electron microscope. Instead, a mercury compressing method may be used. The porosity value is the ratio of the total volume of the pores to that of the porous mold material. The porosity value was measured by using a porosimeter.

The microvickers hardness was measured by using a microvickers hardness meter.

Below a second embodiment of this invention will be explained.

A mixture of 35% by weight of stainless steel short fibers having a length of 2.0 to 3.5 mm prepared by pulverizing stainless steel long fibers (a conversion diameter of 60 to 80 microns) of SUS434 (C: 0.1%, Cr: 18%, Mo: 1%) and 65% by weight of stainless steel particles of SUS434 (C: 0.05%, Cr: 17%, Mo: 2%) with 3% by weight of electrolytic copper particles was pressed under a pressure of 3 tons/cm$^2$ by a cold isostatic pressing method to form a pressed body.

Thereafter, the pressed body was processed similarly to the first embodiment. The pore size in the porous mold and the porosity value were 20 microns and 25%, respectively.

A third embodiment of this invention will be explained below.

A mixture of 60% by weight of stainless steel short fibers 2.0 to 3.5 mm long prepared by pulverizing stainless steel long fibers (a conversion diameter of 60 to 80 microns) of SUS434 (C: 0.1%, Cr: 18%, Mo: 1%) with 40% by weight of stainless steel particles of SUS434 (C: 0.05%, Cr: 17%, Mo: 2%) and 3% by weight of electrolytic copper particles was pressed under a pressure of 3 tons/cm$^2$ by a cold isostatic pressing method to form a pressed body.

Thereafter, the pressed body was processed similarly to the first embodiment. The pore size in the porous mold and the value of the porosity were 50 microns and 35%, respectively.

For reference, three mold materials to be compared with the embodiments of this invention were prepared by the same method as in the embodiments, except for the mixing ratio of the stainless steel particles to the stainless steel short fibers. The mixing ratios of the stainless steel particles to the stainless steel short fibers of references 1, 2, and 3 were 70 wt %:30 wt %, 35 wt %:65 wt %, and 30 wt %:70 wt %, respectively.

EXPERIMENTS

Each of the above mold materials obtained in the three embodiments and the three references was cut and formed into a mold that had the configuration of a step-like cavity 3 as in FIG. 1. Mold materials 1*a* and 1*b* were mounted on mold bases 2*a* and 2*b*, respectively. The inner surfaces 4*a* and 4*b* of the cavity 3 and the back surfaces 5*a* and 5*b* of the mold materials 1*a* and 1*b* were finished to a surface roughness of 3 microns by means of electro-spark processing so as to unclog pores clogged due to the cutting process of the porous mold material, thereby providing an inherent permeability.

As a mold coat, Die Coat 140ESS (trademark) made by Foceco Japan Limited was used. One part of the mold coat was diluted with three parts water, and the diluted solution was applied to the inner surface of the cavity, to improve the flow of a molten metal.

The molten metal of an aluminum alloy (AC4C) was used for the experiments. The alloy at a melting temperature of 700° C. was poured into each of the above molds at a temperature of 300° C. from a gate 6 at a gate speed of 240 mm/second.

The mixing ratios of the particles of stainless steel to the stainless steel short fibers in the three embodiments and the three references are listed in Table 2.

Further, a mold of a configuration similar to that of the molds of the embodiments was prepared using alloyed tool steel SKD61 for a comparison with the embodiments. The alloy at a melting temperature of 700° C. was similarly poured into this mold at a temperature of 300° C. at a gate speed of 240 mm/second.

The word "casting" in this invention means a casting process that uses a mold, such as not only low-pressure casting and counter gravity die casting, but also die casting, gravity casting, or squeeze casting. To compare the mold materials of the embodiments of this invention with the mold materials of the references and the mold material SKD61, the low-pressure casting method and the counter gravity die casting method were used.

In Table 2 the evaluated characteristics of cast products produced by using the molds of the three embodiments and the three references, and the mold made from the mold material SKD61, are listed.

TABLE 2

| Kind of Mold Material | | Porous Mold Materials | | | | | | SKD61 |
|---|---|---|---|---|---|---|---|---|
| Reference Number or Embodiment Number | | R1 | E2 | E1 | E3 | R2 | R3 | |
| Pore Size (microns) | | 7 | 20 | 30 | 50 | 70 | 100 | — |
| Porosity Value (volume %) | | 20 | 25 | 28 | 35 | 42 | 51 | — |
| Mixing Ratio | Particles | 70 | 65 | 50 | 40 | 35 | 30 | — |
| | Short Fibers | 30 | 35 | 50 | 60 | 65 | 70 | — |
| Low-Pressure Casting | Defects in Castings | S | N | N | N | N | S | Y |
| | Clogging of Pores | N | N | N | N | S | S | — |
| Counter Gravity Die Casting | Defects in Castings | S | N | N | N | N | S | Y |
| | Clogging of Pores | N | N | N | N | S | Y | — |

N: None
S: Somewhat
Y: Yes
R1: Reference 1
R2: Reference 2
R3: Reference 3
E1: Embodiment 1

TABLE 2-continued

E2: Embodiment 2
E3: Embodiment 3

Defects in cast products were evaluated based on whether shrinkage or blowholes on the castings were seen. Further, clogging of pores was evaluated based on whether the molten metal clogged pores in the mold.

In Table 2 the letter "Y" means that defects or clogging of pores was seen. The letter "S" means that some defects or clogging of pores were seen. The letter "N" means that no defects or clogging of pore were seen.

As in Table 2, cast products made from the molds of porous mold materials containing pores of 20, 30, and 50 microns and porosity values of 25, 28, and 35% by volume did not show defects such as shrinkage or blowholes of the cast products. Also, the molten aluminum alloy did not clog the pores in the porous mold. The reason is that when the molten aluminum alloy was poured into the mold, the air in the cavity or gaseous materials from the molten aluminum alloy could be uniformly discharged through the pores in the mold so that the adhesion of cast products to the mold was improved. These cast products are produced in the first, second, and third embodiments of this invention.

The cast product made by the mold of reference 1, in which the mixing ratio of the stainless steel particles to the stainless steel short fibers is 70 wt %:30 wt %, showed inferior fluidity for the molten aluminum alloy. Therefore, some shrinkage or blowholes for the cast product were seen. The reason is that the pressure loss of the air is increased when the pore size is 7 microns or less.

On the other hand, the cast product made by the mold of reference 2, in which the mixing ratio of the stainless steel particles to the stainless steel short fibers was 35 wt %:65 wt %, did not show shrinkage or blowholes in the cast product, but showed clogging of pores that would lead to inferior ventilation of the mold. The reason is that the pore size was as large as 70 microns. Further, some clogging of the pores was seen in the mold of reference 2.

For a cast product made from the mold of reference 4, namely, the mold made from the mold material SKD61, the molten aluminum alloy did not flow thrughout the cavity of the mold, so that defects such as shrinkage or blowholes were seen.

As will be understood from the above explanation, the preferred mixing ratios of the stainless steel particles to the stainless steel short fibers are from 40 wt %:60 wt % to 65 wt %:35 wt %. In castings made from the molds of the mold materials in the above mixing ratios, preventing the casting defects is balanced with the mechanical strength of the cast products.

The porous mold material of this invention is characterized by the pore size and the porosity value. By changing the mixing ratio of the stainless steel particles to the stainless steel short fibers, the pore size and the porosity value can be selected.

By this invention, it is unnecessary to provide holes for ventilation or gas exhaust systems in the metal casting process. Therefore, the adhesion of castings to the mold is improved. Further, no clogging of pores in the mold occurs. Therefore, there are many technical effects that reduce the insufficient fluidity of the molten metal in the cavity of the mold and that reduce the gas defects. This will greatly affect the casting industry.

We claim:

1. A porous mold material for casting, said porous mold material being formed from the mixture of powder mainly comprising particles of ferrite stainless steel with stainless steel short fibers, by pressing, sintering, applying a nitrogen injection treatment, and cooling and reheating said mixture, characterized in that said porous mold material contains pores which range from 20 to 50 microns in size, and in that the porosity value of said porous mold material ranges from 25 to 35% by volume.

2. The porous mold material for casting of claim 1, wherein the nitrogen content of said porous mold material is from 1.0 to 1.5% by weight.

3. A method of producing a porous mold material for casting, which mold material contains pores ranging from 20 to 50 microns, the porosity value of said material ranges from 25 to 35% by volume, comprising: pressing the mixture of powder mainly comprising particles of ferrite stainless steel with stainless steel short fibers to form a pressed body, sintering said pressed body to form a sintered body, applying nitrogen injection treatment to said sintered body by heating it under a nitrogen atmosphere to form a nitrided body, rapidly cooling said nitrided body, and reheating said cooled nitrided body, characterized in that the mixing ratio of said stainless steel particles to said stainless steel short fibers is from 40 wt %:60 wt % to 65 wt %:35 wt %.

* * * * *